United States Patent [19]

Adams

[11] Patent Number: 4,570,651

[45] Date of Patent: Feb. 18, 1986

[54] COMBINATION PRESSING COMB DRYER AND BLOW DRYER

[76] Inventor: Charles R. Adams, 1932 W. 25th St. #12, Los Angeles, Calif. 90018

[21] Appl. No.: 672,126

[22] Filed: Nov. 16, 1984

[51] Int. Cl.[4] ..... A45D 1/00

[52] U.S. Cl. ..... 132/9; 34/94

[58] Field of Search ..... 132/9, 118, 129, 136, 132/138, 143; 34/94

[56] References Cited

U.S. PATENT DOCUMENTS 1,308,685 7/1919 Di Salvio ..... 132/9

1,896,933 2/1933 Anastasi ..... 132/9

2,406,490 8/1946 Day ..... 132/118

3,354,890 11/1967 Collison ..... 132/136

*Primary Examiner*—Gregory E. McNeill

*Attorney, Agent, or Firm*—Erik M. Arnhem

[57] ABSTRACT

An elongated cylindrical housing supports a comb structure on one end and an air nozzle on the other. A reversible electrically driven fan is supported within the housing and produces an air flow through the comb, the housing and the nozzle in either direction. Means are provided for heating the air passing through the housing and the comb.

8 Claims, 4 Drawing Figures

Figure 3:
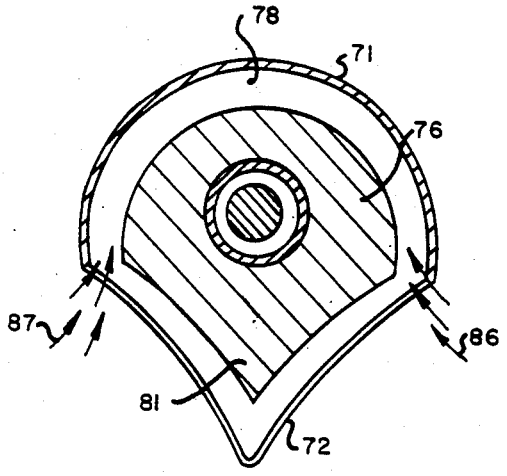

FIG. 1
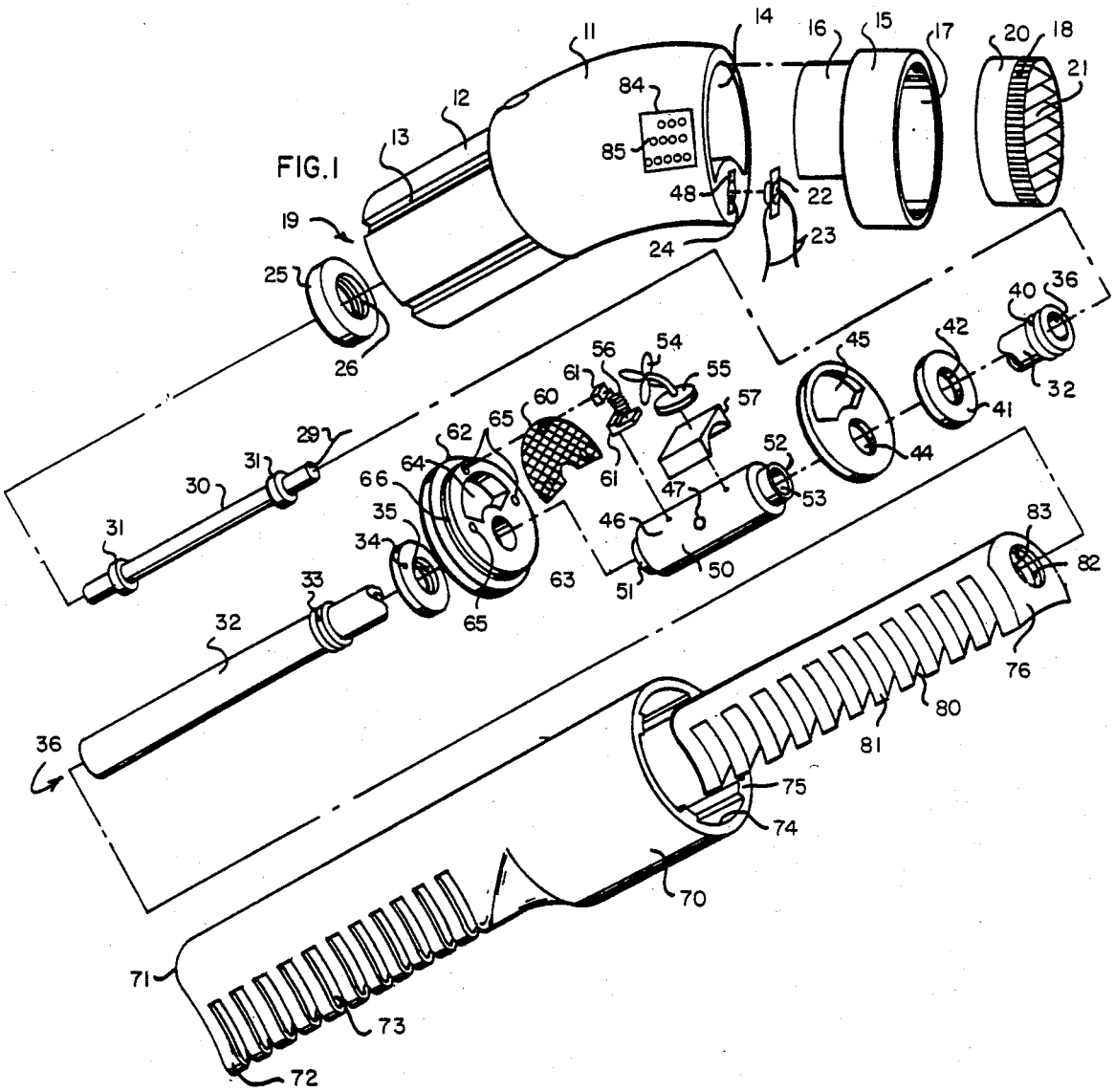
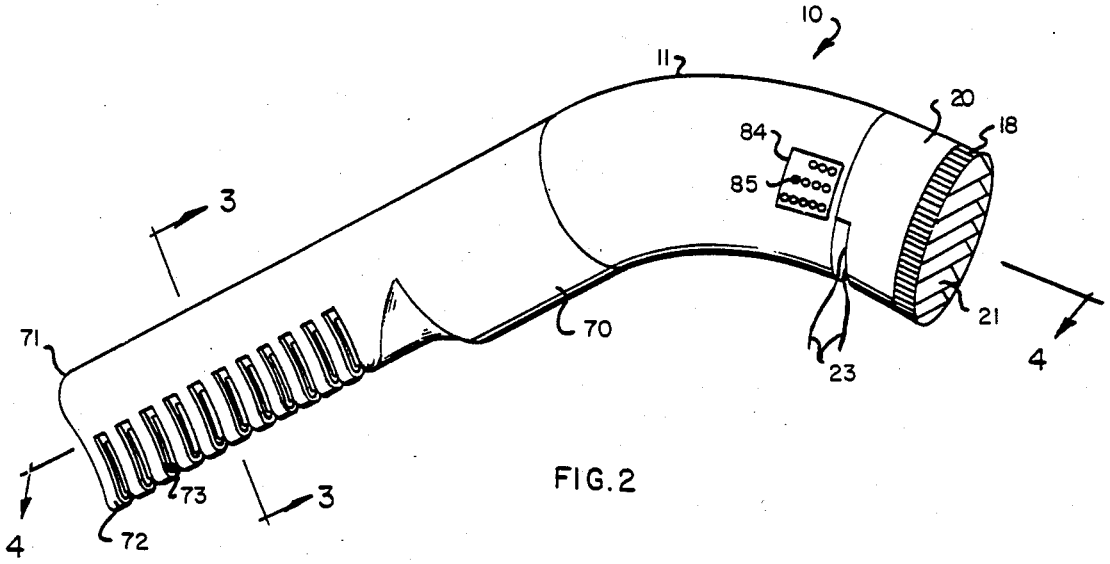
FIG. 2

COMBINATION PRESSING COMB DRYER AND BLOW DRYER

BACKGROUND OF THE INVENTION

This invention relates generally to hair styling devices and particularly to those used to style tightly curled or "kinky" hair.

It has been found by practitioners in the art of hair styling that persons with tightly curled or kinky hair present substantial problems in hair styling. Typically, styling the hair of a person with such tightly curled or kinky hair requires an initial step of shampooing and drying the hair. Generally, a heated pressing comb is repeatedly drawn through the hair to straighten the hair. After the hair is straightened, a hair style is imparted using curling irons and setting techniques typical of other styling procedures. Frequently, the method used in styling tightly curled or kinky hair necessitates the use of four separate devices (a blow dryer, a heater, a pressing comb and curling irons) to produce a total hair style. This represents substantial difficulty and expense to persons seeking to perform hair styling upon individuals having such tightly curled or kinky hair.

The foregoing problems associated with hair styling tightly curled hair have led practitioners in the art to develop devices which aid in styling such tightly curled hair.

While the foregoing described devices provide some beneficial operation in hair styling and drying, there remains a need in the art for a compact, effective, easy-to-use pressing comb and blow dryer which may be manufactured at a low cost and which is easy to use by hair stylists.

Examples of two such devices are set forth in U.S. Pat. No. 3,847,166 and U.S. Pat. No. 4,314,405.

U.S. Pat. No. 3,847,166 illustrates a hair shaper in which a heated comb structure is designed to cooperate with and nest within a heat conductive shaping board. The latter has a generally curved structure suitable for being passed over the subject's hair and applying heat thereto while the friction between the hair and the curved surface draws the curly hair to a more straight orientation. Once the hair is drawn straight, the heat tends to set the hair in its straightened configuration.

U.S. Pat. No. 4,314,405 sets forth a hair cutting device which includes a reversible motor and heating element disposed within a housing having a central passage extending therein. The general appearance of the device resembles a conventional blow-dryer. A fan within the housing is capable of being driven in a suction mode by activation of a drive motor. In the suction mode, hair is drawn into the housing and brought into contact with a plurality of hair cutting impeller blades whereby the hair is cut at a predetermined length defined by the extension of the housing. In addition, the direction of fan motion may be reversed to a blower mode and a heater activated which produces a more conventional blower dryer operation.

SUMMARY OF THE INVENTION

Accordingly, it is general object of the present invention to provide an improved hair styling apparatus. It is more particular object of the present invention to provide an improved hair styling apparatus which is particularly adapted to use with tightly curled or kinky hair. It is a still more particular object of the present invention to provide an improved hair styling apparatus suitable for use on any texture of hair, and particularly on tightly curled or kinky hair which is housed in a single multi-function, housing and which is easy to manipulate by a hair stylist.

In accordance with the present invention there is provided a combination pressing comb and blow dryer in which an elongated generally cylindrical housing defining a longitudinal air passage therethrough supports a reversible electrically driven fan and a plurality of electric heaters positioned within the air stream. A first plurality of teeth are configured on one end of the device and are separated by a plurality of serrations aligned with grooves 13 to insure proper alignment of interior pressing comb 76 with respect to exterior comb 71. Thereafter handle extension 12 is fully inserted into extension cavity 74 and the resulting assembly is completed by securing interior come 76 within comb cavity 90 by using a fastener 91. As is shown more clearly in FIG. 4, fastener 91 is passed through an aperture 93 defined in exterior comb 71 and is received by a threaded aperture 92 in interior comb 76.

It will be understood by those skilled in the art that the foregoing mechanical structure and assembly may be varied without departing from the spirit and scope of the present invention. It will be further understood by those skilled in the art that the foregoing assembly will further include the steps required to complete the appropriate electrical connections between primary heating element 30, fan motor 55, secondary heater 56, receptacle 24 and control face 84. The latter is shown more clearly in FIG. 2.

FIG. 2 shows the exterior view in perspective of the completed structure of the present invention combination pressing comb and blow dryer. As is shown in FIG. 2, handle 11 further defines a control face 84. A plurality of controls 85 are supported upon control face 84 and by appropriate electrical connections (not shown) provide the coupling of electrical power between wires 23 and primary heating element 30, secondary heater 56, and fan motor 55 to accomplish the below described operations. Examination of FIG. 2 shows an important advantage of the present invention structure. Because the resulting structure is a single unitary device having a comb structure at one end of its generally elongated configuration, an air nozzle at the other end and a convenient handle therebetween, the general shape is one which permits manipulation convenient in one hand by a hair stylist.

FIG. 3 shows a cross section of the present invention dryer comb taken through section lines 3—3 in FIG. 2. As can be seen, interior comb 76 is supported within comb cavity 90 in a manner creating an air space 78 surrounding interior comb 76 within exterior comb 71. As mentioned above the serrations 73 and 80 in exterior comb 71 and interior comb 76 respectively are maintained in substantial alignment with the result that an air passage into air space 78 is created. Also shown in FIG. 3 the relationship between primary heating element 30 and interior comb 76 is such that heat produced by the former is communicated to the latter. As a result, when primary heating element 30 is energized in accordance with the below described operation of the present invention, interior comb 76 may be raised to a substantially elevated temperature.

Figure 4:
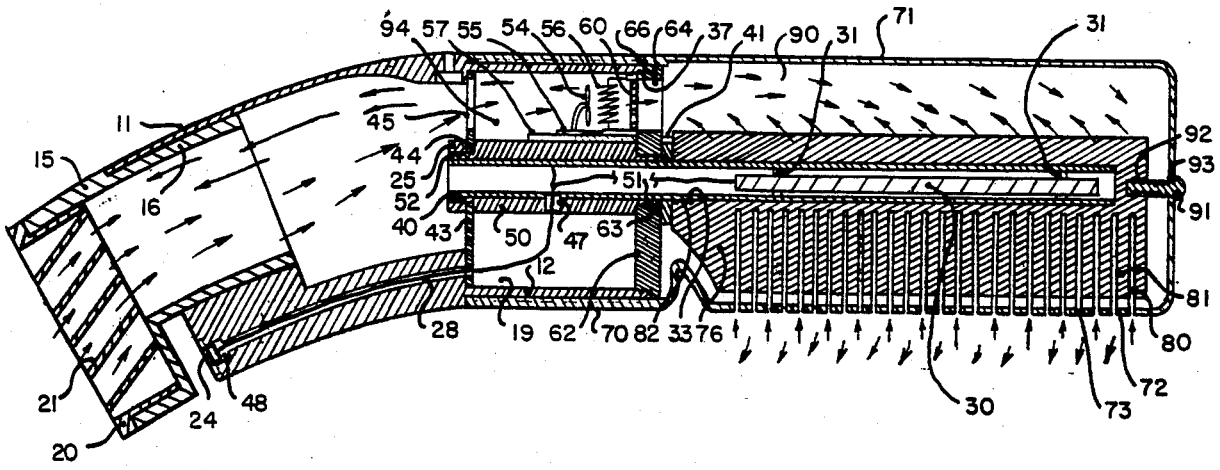

FIG. 4 shows a complete section view of the present invention dryer comb taken along section lines 4—4 in FIG. 2. Examination of FIG. 4 shows the completed assembled structure described above in connection with FIG. 1 situated within handle 11 and comb housing 70. As can be seen by examination of the section view in FIG. 4, an air path is created between serrations 80 of exterior comb 71 and serrations 73 of interior comb 76 into comb cavity 90 and through window 64 of center plate 62 into fan chamber 94 within cavity 19. This air passage continues through windown 45 in plate 43 into handle cavity 14 of handle 11 and finally through louvres 21 of nozzle housing 15. As a result, operation of fan 54 in a selected direction can cause alternatively one of two air flows to be set up.

In the first air flow by operating fan 54 in a first direction air is drawn into comb cavity 90 through serrations 73 and 80 and passes sequentially through window 64 fan chamber 94 window 45 handle cavity 14 and is discharged through louvres 21. Conversely, with the operation of fan 54 in the alternate direction, air is drawn in through louvre 21 through handle cavity 14 then through windown 45 into fan chamber 94 and is thereafter discharged through window 64 comb cavity 90 and exits through serrations 73 in exterior comb 71.

In either case it is important to note that both secondary heater 56 and the heatable structure of interior comb 76 are positioned within the air flow passing through dryer comb 10. As a result, the manipulation of the selected controls 85 on control face 84 permits the degree of heat as well as direction of air flow for the present invention to be controlled. For example, with the direction of fan motor 55 selected that air is drawn into serrations 73 and discharged through louvres 21. The present invention (pressing comb dryer) may be used to comb, dry and straighten the hair. When the air flows into serrations 73, the hair is drawn into alignment within serrations 80 of the interior of comb 76. In this operation, the heated interior of comb 76 and the suction action from air passing through serrations 80 carry the subjects hair into a substantially straight alignment and the heated comb and air flow combined provides means to dry and straighten the hair. Thus, the heated comb combined with the suction action from the air flow, sucks the moisture from the hair and the heated comb completes the drying. The pressing comb dryer when drawn through the subject's hair will cause the hair to be combed, dryed and straighten.

When utilized as a blow dryer, the direction of fan motor 55 is reversed such that air is drawn into louvres 21 and exits through serrations 73. In this application, a flow heated air is supplied to exit between serrations 73 for drying the hair. If desired in this application, comb 76 can be used in combination with this application for faster drying.

The comb in this mode is used in the same manner as conventional styling combs in that a blow drying action together with a combing styling action is provided by drawing the comb through the subject's hair. For example, kinky hair can be relaxed to a desired texture and tightly curled hair can be relaxed to a wavy texture by the manipulation of the selected controls 85 on control face 84 permitting the degree of heat as well as direction of air flow to be controlled.

As mentioned four different devices are presently being used to style tightly curled or kinky hair. This invention combines three of these devices into one, the dryer, heating stove and pressing comb so as to eliminate overheating the hair causing damage to the latter. In styling hair, this invention allows one to bring about a healthy head of hair in a more efficient, faster, less expensive manner. In addition, many other advantages both to the clients as well as for the operators.

While particular embodiments of the invention have been shown described it will be obvious to those skilled in the art that change and modifications may be made thereto without departing from the invention in its broader aspects and therefore the aim and the appended claims is to cover all such changes and modifications as fall within the true spirit and scope of the claimed invention.

I claim:

1. For use in styling hair a combination pressing comb and blow dryer comprising:

an elongated housing defining an internal cavity and having, a first end defining a first plurality row of teeth and a first plurality of serrations spaced between each of said teeth in said first plurality of teeth, said first plurality of serrations permitting air passage between the exterior of said elongated housing and said internal cavity, a second end defining an air nozzle having an opening coupled to said internal cavity;

a heat conductive interior comb defining a second plurality of teeth and a second plurality of serrations spaced therebetween and supported within said internal cavity such that said first and second plurality of serrations are in substantial alignment;

means for electrically heating said interior comb;

an electrically driven air impeller supported within said internal cavity; and control means, supported by said elongated housing, for controlling the temperature of said interior comb and said electrically driven air impeller.

2. A combination pressing comb and blow dryer as set forth in claim 1 wherein said elongated housing defines a cylindrical shape and wherein said first and second ends are situated at the opposite ends thereof.

3. A combination pressing comb and blow dryer as set forth in claim 2 wherein said internal cavity extends from said opening in said air nozzle to said first plurality of serrations.

4. A combination pressing comb and blow dryer as set forth in claim 3 wherein said internal cavity defines a fan chamber at the approximate mid-point of said elongated housing and wherein said electrically driven air impeller includes:

a multi-bladed fan rotatably supported within said fan chamber;

an electric motor coupled to said control means; and means mechanically coupling said multi-bladed fan to said electric motor.

5. A combination pressing comb and blow dryer as set forth in claim 4 wherein said interior comb defines an elongated cavity and wherein said means for electrically heating includes:

a first resistive electric heating element supported within said elongated cavity; and means electrically coupling said first resistive electric heating element to said control means.

6. A combination pressing comb and blow dryer as set forth in claim 5 further including:

a second resistive electric heating element supported within said fan chamber; and means electrically coupling said second resistive electric heating element to said control means.

7. A combination pressing comb and blow dryer as set forth in claim 6 wherein said elongated housing defines a curved portion between said first and second ends.

8. A combination pressing comb and blow dryer comprising:

an elongated hollow cylindrical housing terminating in first and second end apertures;

a reversible electric motor and rotatable fan combination supported within said cylindrical housing;

an elongated hollow comb coupled to said first end aperture and defining a first plurality of teeth and a first plurality of serrations between said first plurality of teeth providing air passage apertures to the interior of said hollow comb;

an elongated interior comb defining longitudinal bore and a second plurality of teeth supported within said hollow comb such that said first and second plurality of teeth are in substantial alignment;

an air directive nozzle rotatably supported within said second end aperture defining a plurality of parallel louvres for deflecting air passing therethrough;

an elongated primary heater supported within said longitudinal bore;

a secondary heater supported within said fan chamber; and, control means, supported by said cylindrical housing, having a plurality of electric control elements and means for selectively coupling said primary heater, said secondary heater and said reversible electric motor to a source of conventional electrical power such that the heating of said primary and secondary heaters and the direction of air flow through said cylindrical housing may be controlled.

* * * * *